US005695061A

United States Patent [19]

Stompe

[11] Patent Number: 5,695,061

[45] **Date of Patent: *Dec. 9, 1997**

[54] LITERATURE HOLDER AND BLANK THEREFOR

[76] Inventor: Brian Keating Stompe, 110 San Mateo Way, Novato, Calif. 94945

[ * ] Notice: The term of this patent shall not extend beyond the expiration date of Pat. No. 5,423,425.

[21] Appl. No.: 430,761

[22] Filed: Apr. 27, 1995

Related U.S. Application Data

[63] Continuation-in-part of Ser. No. 123,346, Sep. 17, 1993, Pat. No. 5,423,425.

[51] Int. Cl.[6] ..... B65D 85/48; A47H 1/04

[52] U.S. Cl. ..... 206/449; 206/526; 211/70.1; 211/90; 211/94; 248/205.3; 248/223.41

[58] Field of Search ..... 248/205.3, 217.4, 248/223.41, 214, 911; 211/50, 55, 70.1, 90, 94; 206/449, 526, 44 B

[56] References Cited

U.S. PATENT DOCUMENTS

| | | | |
|---|---|---|---|
| 2,333,717 | 11/1943 | Heed et al. | 211/50 X |
| 2,755,576 | 7/1956 | Golden | 248/205.3 |
| 3,178,138 | 4/1965 | Hessdoerfer et al. | 248/205.3 X |
| 3,744,623 | 7/1973 | Woofter | 248/205.3 X |
| 4,016,977 | 4/1977 | Krautsack | 248/205.3 X |
| 4,152,851 | 5/1979 | Goldstein | 206/526 X |
| 4,215,840 | 8/1980 | Babbert | 248/214 X |
| 4,420,082 | 12/1983 | Bernie | 248/220.3 X |
| 4,630,731 | 12/1986 | Albery | 206/425 |
| 4,678,151 | 7/1987 | Radek | 248/223.41 |
| 4,828,121 | 5/1989 | Willcocks, Jr. | 211/94 |
| 5,042,768 | 8/1991 | Goldstein | 248/223.41 |

OTHER PUBLICATIONS

Fasteners For Retail, Inc. Catalog pp. 61 thru 66 (Mar. 1, 1995 Catalog).

*Primary Examiner*—Bryon P. Gehman

[57] ABSTRACT

Improvements may be incorporated in the literature holder and blank therefor, which allow it to be attached to display surfaces other than shelf pricing channel. For attachment of the literature holder to vertical surface with horizontal opening, improvement may be made wherein four cuts are made from the four points where the shelf strip panels meet the side panels, and which said cuts extend to a point which enables the shelf strip panels to be flexed so they may be inserted in horizontal openings of vertical surface. Improvement may be made to the holder and blank therefore with addition of four holes located so that cuts may be made to them from the four points where the shelf strip panels meet the side panels, which enables the shelf strip panels to be flexed so they may be inserted in horizontal openings of a vertical surface. The literature holder and blank therefore may be improved by addition of holes through which fasteners may be passed to attach the literature holder to corresponding holes on peg board. The literature holder may be improved by providing a single bottom panel attached to both side panels which permits use of the holder without having to form it from a blank.

13 Claims, 6 Drawing Sheets

LITERATURE HOLDER AND BLANK THEREFOR

This is a continuation-in-part of application Ser. No. 08/123,346, filed Sep. 17, 1993, now U.S. Pat. No. 5,423,425.

BACKGROUND OF THE INVENTION & DESCRIPTION OF PRIOR ART

I. Field of Invention

This invention relates to "Literature Holder and Blank Therefore", with improvements described herein, which enable the holder assembled from the improved blank, to be attached to other surfaces, in addition to shelf pricing channel, so that the holder is attached leveraged against the surface at 90 degrees to the surface, presenting a narrow profile economical of display space and so that literature held in it may be seen by people approaching from either direction, and improvement whereby the holder is molded with a single bottom panel.

II. Decription of Prior Art

The Store Shelf Literature Holder formed from the blank is constructed to attach to a store shelf pricing channel, which fronts retail store shelves, leveraged against the shelf in such a way that the holder presents itself and literature placed in it at 90 degrees from the shelf, providing a view of the literature for persons approaching from either direction, while presenting a narrow profile in front of the shelf that does not interfere with display of, or withdrawal of, product from the shelf to which the holder is attached.

In some stores products and communicative display material are displayed from a vertical surface with a horizontal opening, which surface is known as "slat wall" or "horizontal wire". Other stores display products and communicative display material from peg board, which is a vertical surface with holes spaced with horizontal centers a uniform distance apart. Products or display material may be attached by means of pegs inserted through holes in the item into the peg board holes. It would be advantageous, if the same literature holder with narrow profile which displays literature at 90 degrees from a shelf pricing channel could also display literature with the same narrow profile at 90 degrees from a horizontal opening or peg board display surface, being conservative of display space, while displaying literature to people approaching from either direction. It would be advantageous if the literature holder could serve in multiple locations. It would be convenient if the literature holder could be used without having to form it from the blank.

III. Summary of the Invetnion

Accordingly, it is an object to provide improvements to this Literature Holder and blank therefore that will allow it to be attached to a vertical display surface with horizontal opening or to peg board or other surfaces, and to leverage the holder against the surface to which it is attached so that the holder and literature are held at 90 degrees to the surface, providing an outline of the holder and literature economical of display space, and which presents literature held in it at an approximately level attitude for viewing by people approaching from either direction.

It is an objective to provide improvement to this literature holder and blank therefore that permit it to be attached to a vertical surface with horizontal openings without having to first attach an additional fastener to the literature holder.

It is an objective to provide the literature holder molded with a single bottom panel, eliminating the need to assemble it from the blank.

Other objectives and advantages of the improvements which may be made to this invention will become apparent upon reading the following detailed description and reference to drawings.

DETAILED DESCRIPTION OF PREFERRED EMBODIMENT

Figure 1:
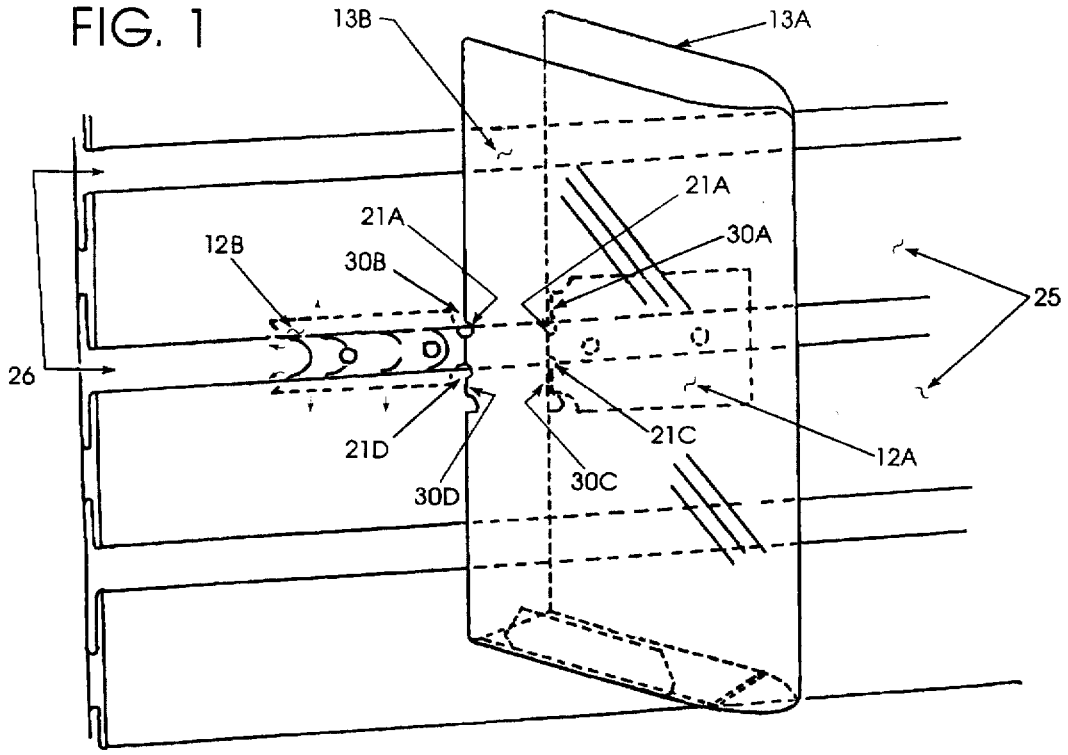
FIG. 1 shows the assembled improved literature holder assembled from the blank attached to slat wall or horizontal wire equivalent of slat wall display surface.

Turning to the figures of the drawings, there is seen in FIG. 1, slat wall display surface, the flat surface of which is indicated generally by 25, is undercut by a recessed channel generally indicated by 26, providing a means of fastening products to be displayed and informational material to the slat wall surface. The same mechanical principle for attachment is used for attaching to horizontal metal wire, generally referred to as 27, and as shown in FIG. 2, which wire runs parallel, as do the slat wall channels, providing the same opportunity for attachment.

Figure 2:
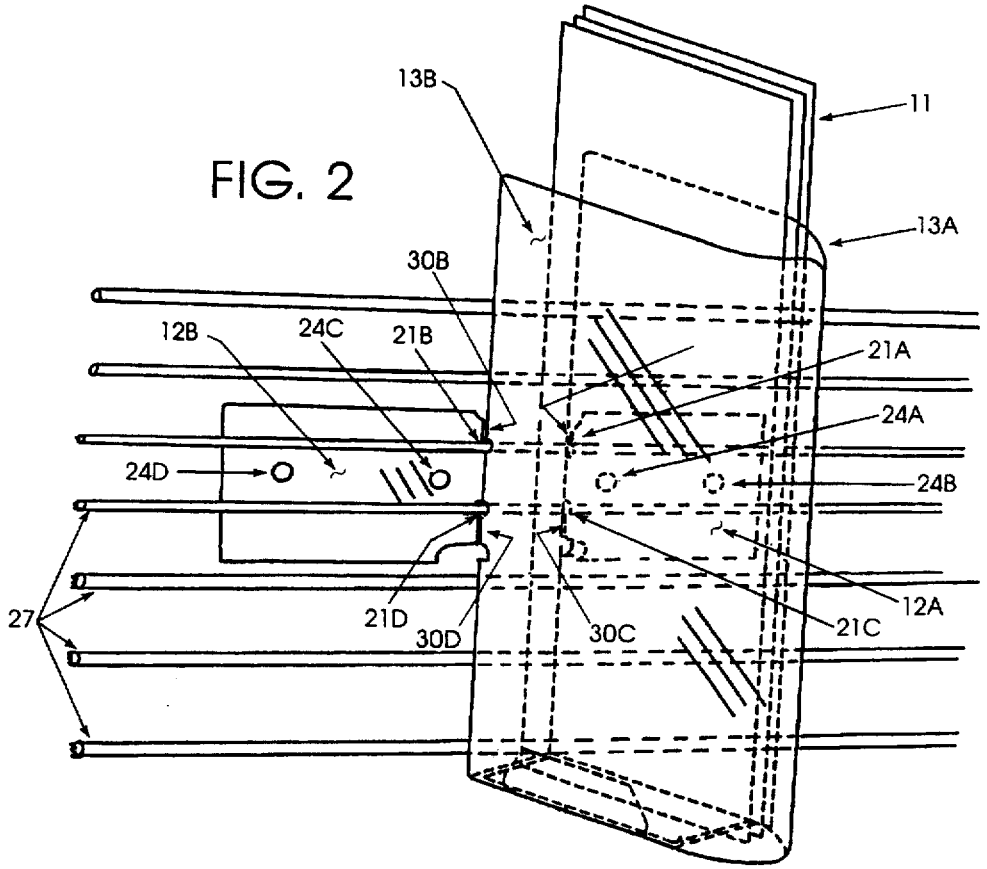
FIG. 2 shows the improved literature holder assembled from the blank attached to horizontal wire display surface with literature in the holder.

The literature holder in FIG. 1 has been improved with cuts 30A,B,C and D which permit shelf strip panels 12A and 12B to flex, as illustrated with shelf strip 12B so they can be inserted and released to lodge, as illustrated by shelf strip 12 A, in the channels of the slat wall or between horizontal wire display surface, as illustrated in FIG. 2.

FIG. 2 illustrates the improved blank assembled to form a literature holder being attached to horizontal wire display surface with shelf strips 12A and 12B secured behind horizontal wire, 27, with literature, 11, displayed from the holder.

Figure 3:
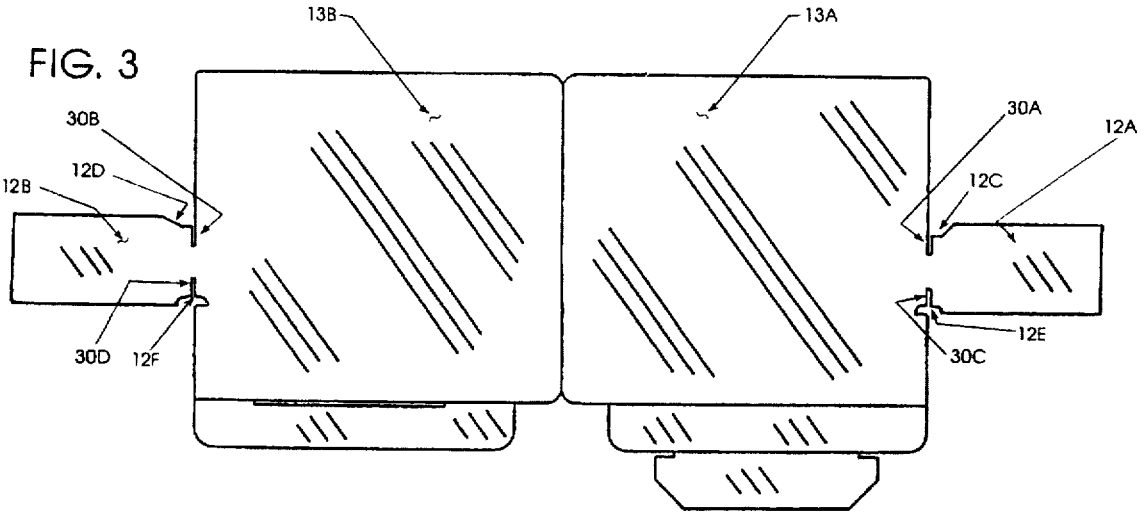
FIG. 3 shows the improved blank of the literature holder with addition of cuts.

FIG. 3 illustrates the blank for the literature holder improved with cuts 30A,B,C & D, which permit shelf strips 12A and 12 B to flex to insert between wire or in slat wall.

Figure 4:
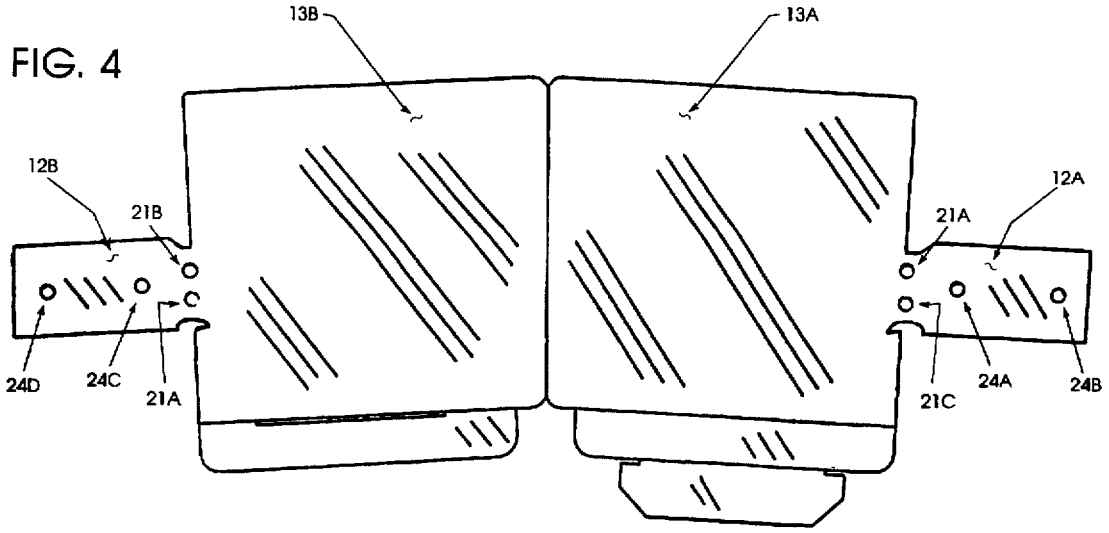
FIG. 4 shows the improved blank of the literature holder with addition of holes.
Figure 5:
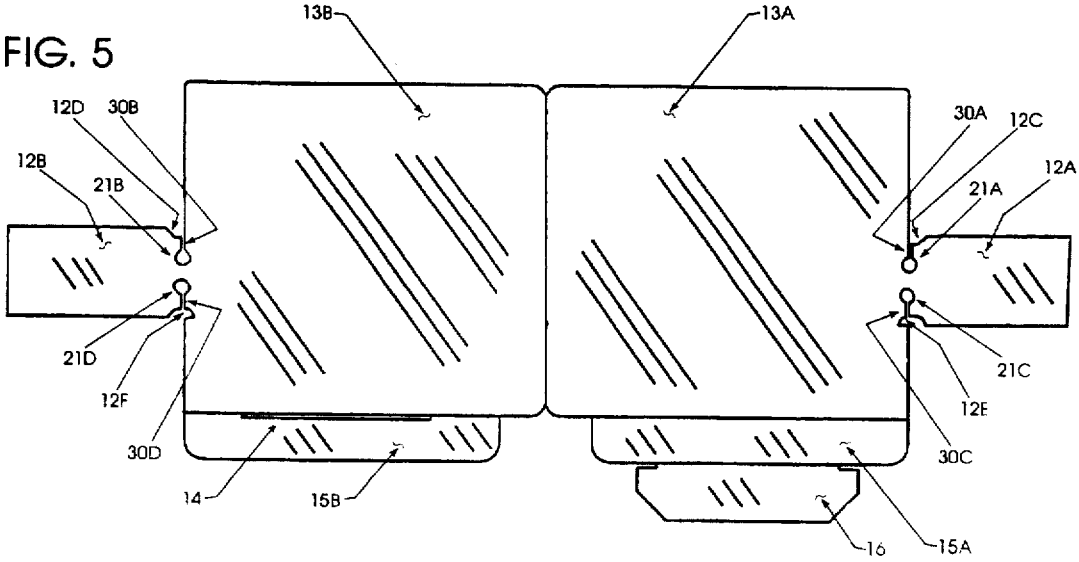
FIG. 5 shows the improved blank of the literature holder with addition of holes and cuts.

FIG. 4 illustrates the blank for the literature holder improved with holes 21A,B,C and D, which are shown in FIG. 5 joined with cuts 30 A,B,C, and D.

Figure 6:
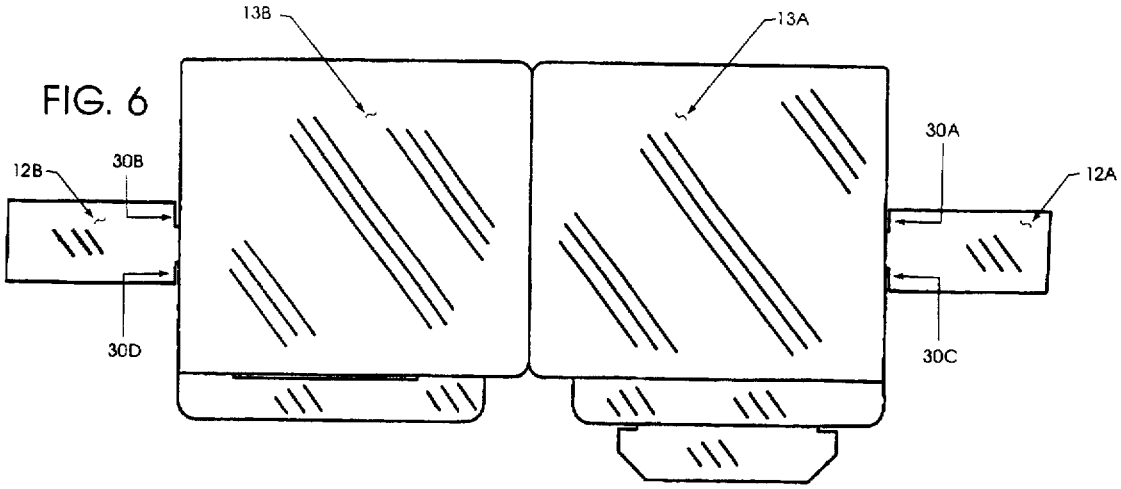
FIG. 6 shows the improved blank of the literature holder with cuts.
Figure 7:
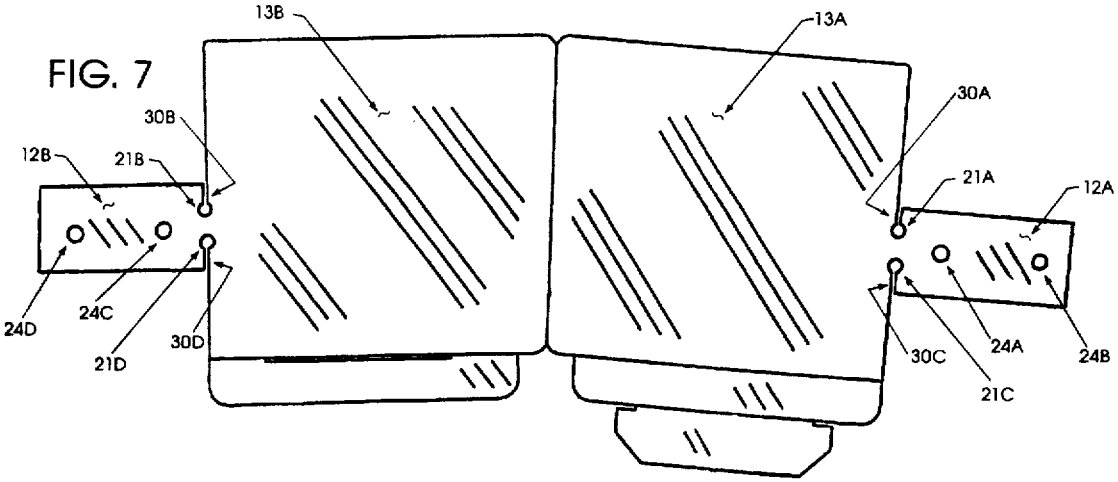
FIG. 7 shows the improved blank of the literature holder with cuts and holes.

FIGS. 6 and 7 illustrate the blank for the literature holder as it may be manufactured without cuts 12C,D,E, and F, which are present in FIGS. 3,4, and 5, but absent in figures 6 and 7. The blank of the literature holder in FIG. 6 has been improved with the addition of cuts 30A,B,C and D, and the literature holder in FIG. 7 has been improved with addition of both cuts 30A,B, C and D, and holes 21 A,B,C and D which permit panels 12A and 12B to flex for insertion in slat wall or between wire.

Figure 8:
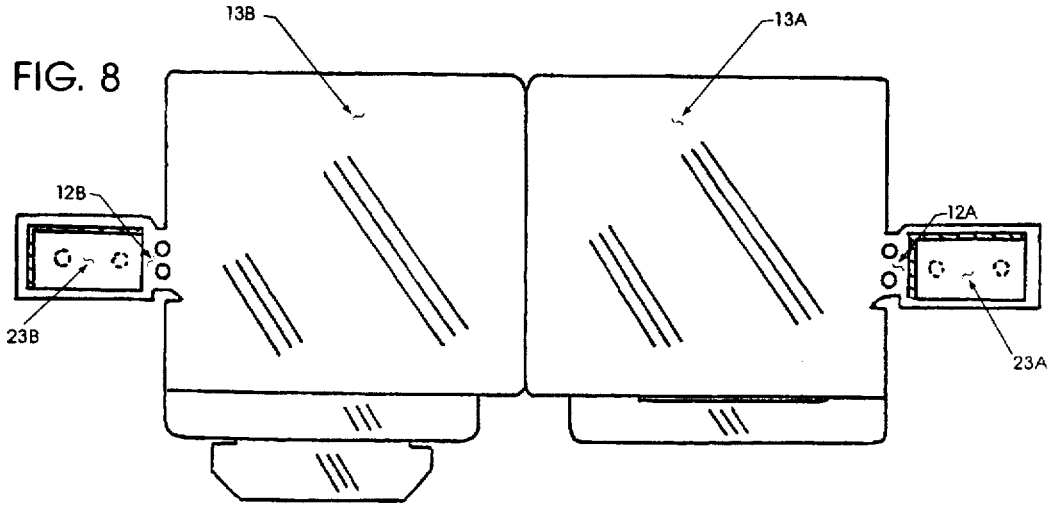
FIG. 8 shows the improved blank of the literature holder with the addition of adhesive.

FIG. 8 illustrates the blank from which the literature holder is assembled and which blank has been improved to include adhesive 23A and 23B applied to panels 12A and 12B. The adhesive is pressed against the flat side, 24, of a paperboard box in FIG. 10, or may be pressed against any surface which will accept the adhesive, securing the literature holder securely leveraged against the surface as illustrated so it can display literature indicated by 11, at an approx. level attitude at 90 degrees from the surface. Holes 24A,B,C, and D and holes 21 A,B, C, and D in FIG. 2 are present and are seen not to interfere with the function of the adhesive which attaches the literature holder to the side of the box in FIG. 11.

Figure 9:
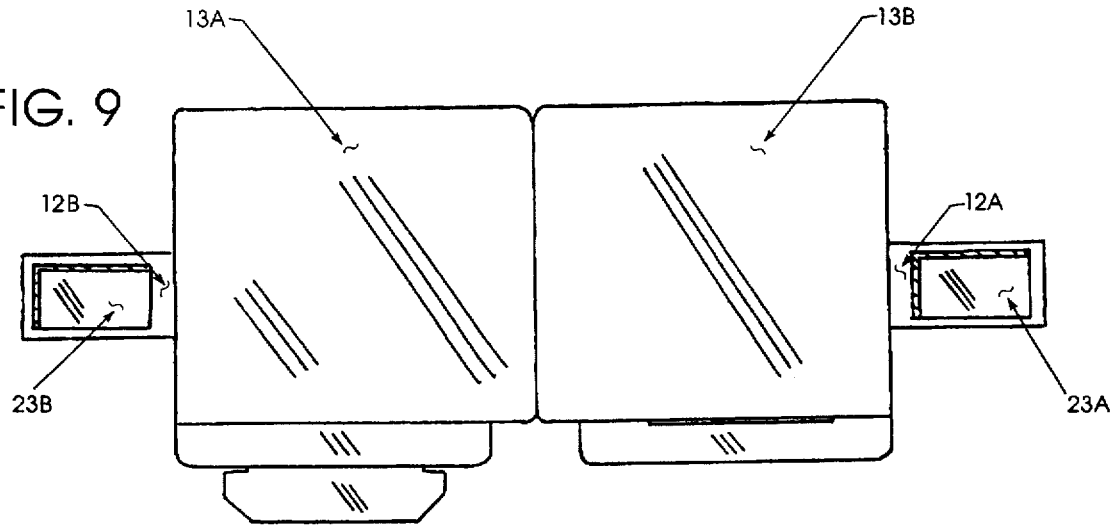
FIG. 9 shows the improved blank of the literature holder with the addition of adhesive.
Figure 10:
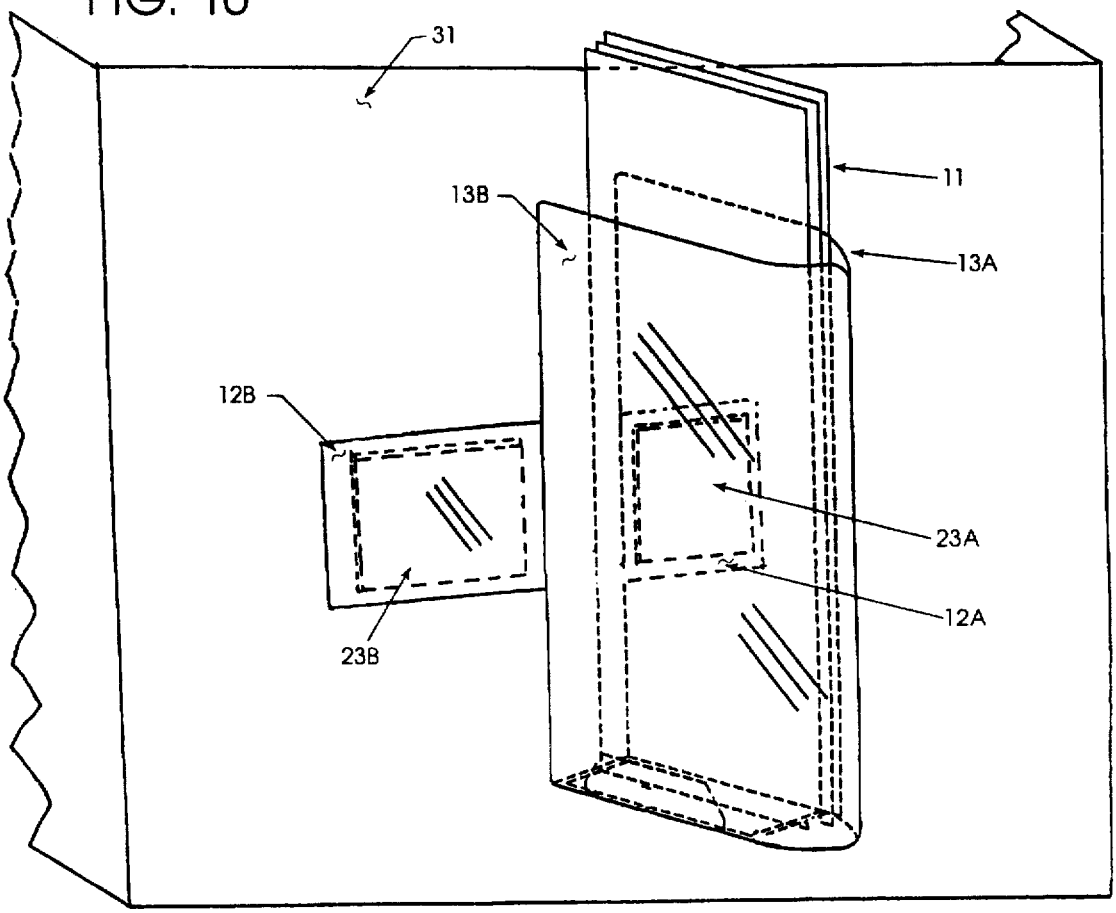
FIG. 10 shows the literature holder assembled from the improved blank attached by it's adhesive panels to the side of a box.
Figure 11:
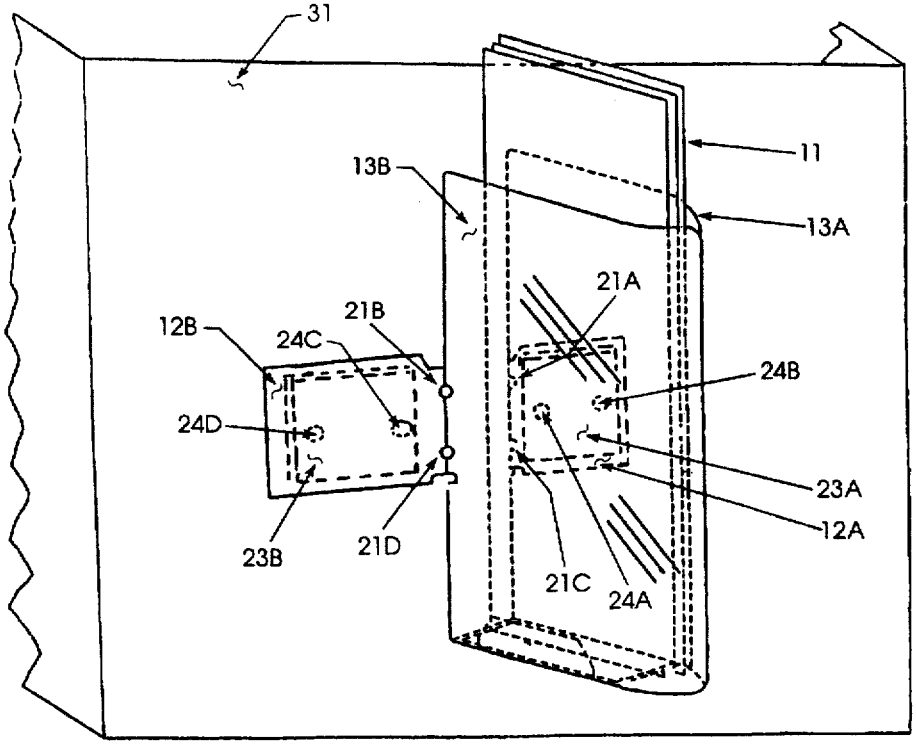
FIG. 11 shows the literature holder assembled from the improved blank attached by it's adhesive panels to the side of a box.

In FIG. 9 the blank for the literature holder is shown without cuts 12C,D,E and F, which are not necessary if the holder is to be used with adhesive shown as 23A and 23B attached to panels 12A and 12 B, and illustrated in FIG. 10.

Figure 12:
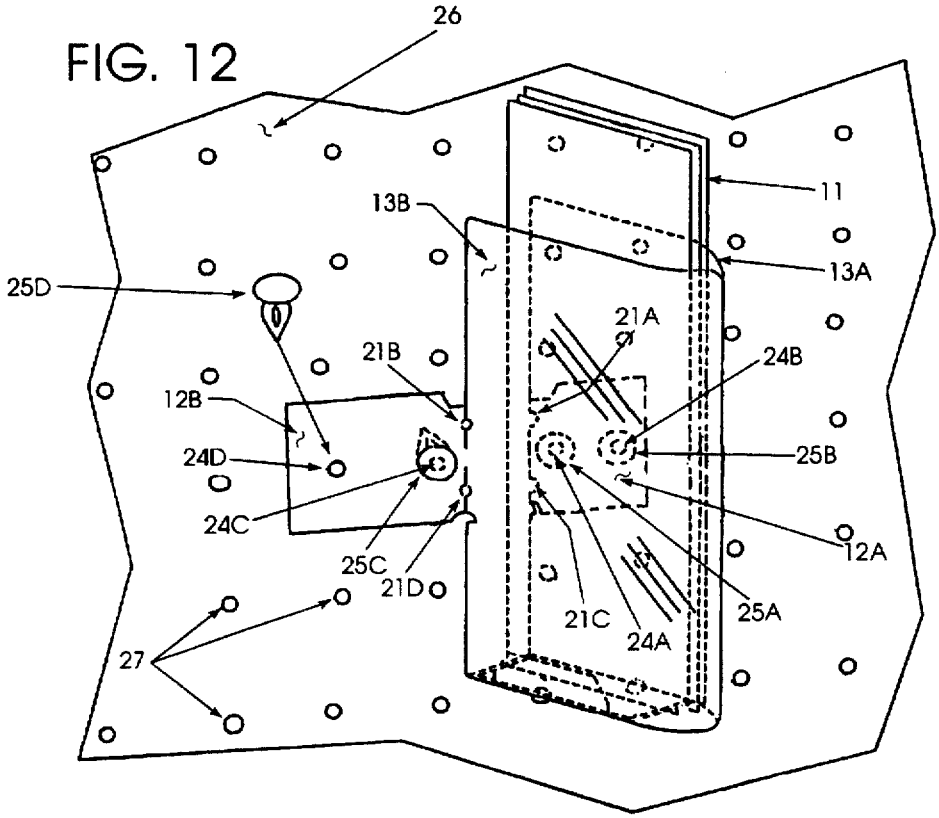
FIG. 12 shows the literature holder assembled from the improved blank attached to peg board.

The blank which has been assembled into a literature holder in FIG. 12, is attached to peg board, 26, by passing fasteners illustrated as 25A,B,C and D through holes 24A, B,C and D in shelf strip panels 12A and 12B, securing the literature holder leveraged against the peg board to display literature, 11.

Figure 13:
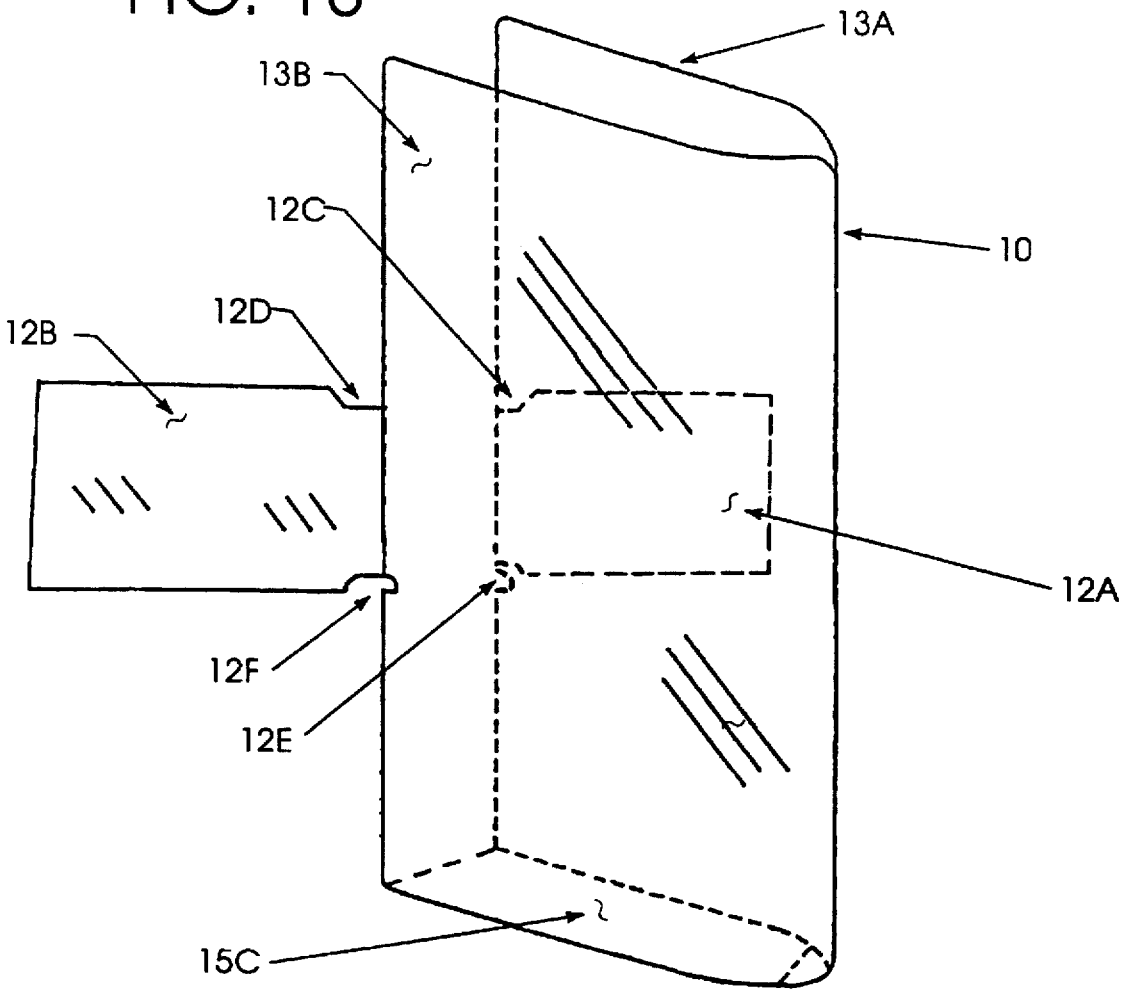
FIG. 13 shows the improved literature holder in molded preassembled form.

The literature holder of FIG. 13 is improved by being in a molded pre assembled form, the bottom of which is illustrated as 15C, which joins both panels 13A and 13B, and eliminates Tab16, Slit 14, and panels 15A and 15B which are illustrated in FIG. 5.

What is claimed is:

1. A substantially flat, die cut and scored blank made of thin stiff material, for assembling into a holder for brochures, coupons or folders, which will be referred to as literature, comprising in combination, two die cut shelf strip panels, each having an angled cut on one side, and a cut shaped like the round metal edge of a retail store's pricing channel, which forms the facing edge of a store shelf, on the other side; two rectangular side panels, for holding literature in the holder upright when the holder is assembled from the blank form, attached to and adjoining the two shelf strip panels and which side panels meet together at a common score; two bottom panels, attached to the side panels, and which bottom panels, when the flat blank is assembled, provide a secure bottom platform for the holder's contents, bracing the side panels in position, each of which bottom panels hinge from a score on the edge of the two side panels; a die cut termination of the two rectangular bottom panels by die cutting them short of the length which they extend along the rectangular side panels by a distance approximately equal to the width of the bottom panels, which when the flat blank is assembled is approximately the inside width of the holder, enabling the holder to fold at the score joining the two side panels without binding or bunching at the end, providing a smooth narrow contour to the end of the literature holder when assembled; a male tab lock which extends from one of the bottom panels which adjoins one of the rectangular side panels, can tuck into, and lock with a female lock cut in the score of the other bottom panel which adjoins the opposite side panel, which when the flat blank is formed into a holder, forms a bottom platform upon which literature may be placed, and holds the side panels in place; wherein the improvement comprises cuts made from the four corners where the shelf strip panels meet the side panels and which cuts extend from where the side panels and shelf strip panels meet to a point where the four cuts will permit the shelf strip panels to flex, whereby the shelf strip panels of the literature holder assembled from the blank may be flexed for insertion in a horizontal opening in a vertical surface, which opening is provided for attachment of objects to the surface, so that when the shelf strip panels are inserted in the opening they will hold the literature holder leveraged against the surface with the narrow profile of the holder at a 90 degree angle to the surface, which is economical of display space and presents literature which may be held in it for viewing by people approaching from either direction.

2. A substantially flat, die cut and scored blank made of thin stiff material, for assembling into a holder for brochures, coupons or folders, which will be referred to as literature, comprising in combination, two die cut shelf strip panels, each having an angled cut on one side, and a cut shaped like the round metal edge of a retail store's pricing channel, which forms the facing edge of a store shelf, on the other side, two rectangular side panels, for holding literature in the holder upright when the holder is assembled from the blank form, attached to and adjoining the two shelf strip panels and which side panels meet together at a common score; two bottom panels, attached to the side panels, and which bottom panels, when the flat blank is assembled, provide a secure bottom platform for the holder's contents, bracing the side panels in position, each of which bottom panels hinge from a score on the edge of the two side panels; a die cut termination of the two rectangular bottom panels by die cutting them short of the length which they extend along the rectangular side panels by a distance approximately equal to the width of the bottom panels, which when the flat blank is assembled is approximately the inside width of the holder, enabling the holder to fold at the score joining the two side panels without binding or bunching at the end, providing a smooth narrow contour to the end of the literature holder when assembled; a male tab lock which extends from one of the bottom panels which adjoins one of the rectangular side panels, can tuck into, and lock with a female lock cut in the score of the other bottom panel which adjoins the opposite side panel, which when the flat blank is formed into a holder, forms a bottom platform upon which literature may be placed, and holds the side panels in place; wherein the improvement is comprised of four holes, two of said holes cut in each of the two shelf strip panels, and each being located inward from the exterior where the shelf strip panel and the side panel meet, at a point where if cuts are made to each of the four holes from the exterior of the shelf strip panels where they join the side panels, the shelf strip panels of the literature holder assembled from the blank can be flexed for insertion in a horizontal opening in a vertical surface, which opening is provided for attachment of objects to the surface, so that when the shelf strip panels are inserted in the opening they will hold the literature holder leveraged against the surface with the narrow profile of the holder at a 90 degree angle to the surface, which is economical of display space and whereby the addition of the said holes permit use of the literature holder on a shelf pricing channel until such time as cuts may be made to the holes.

3. The blank described in claim 2 wherein the improvement consists of four cuts made from where the shelf strip panels meet the side panels and which cuts extend from where the side panels and shelf strip panels meet to a point where the four cuts join the holes, which will permit the shelf strip panels of a literature holder assembled from the blank to be flexed for insertion in a horizontal opening in a surface, which opening is provided for attachment of objects to the surface, so that when the shelf strip panels are inserted in the opening they will hold the literature holder leveraged against the surface with the narrow profile of the holder at a 90 degree angle to the surface, which is economical of display space, and which presents literature which may be held in the literature holder at an approximately level attitude for viewing by people approaching from either direction.

4. The blank described in claim 2, wherein the improvement consists of the addition of four holes, two of said holes to both of the shelf strip panels, the horizontal centers of which said two holes in each of the two shelf strips are separated and which horizontal distance between their centers relates to the horizontal distance between the center of holes which are on peg board, commonly used for display surface, and which peg board holes are consistently spaced, whereby the shaft of a friction fit fastener, which shaft is attached to a broad flat head, can pass one fastener through each of the said four holes in the shelf strip panels when the holder is assembled from the blank, into the peg board surface, leveraging a literature holder assembled from the blank securely against the surface with the narrow profile of the holder at 90 degrees to the surface, which is economical of display space and presents literature which may be held in it for viewing by people approaching from either direction.

5. A holder for literature made of thin stiff material, comprising two die cut shelf strip panels, each of which have an angle cut in the top surface, and a circular cut describing the shape of the round edge of a retail store's pricing channel which is located at the outer edge of a shelf facing the store aisle in the bottom surface; two rectangular side panels for holding the contents of the holder upright, attached to and adjoining the two shelf strip panels, and which side panels are hinged together by a score; two rectangular bottom panels, attached to the side panels, which bottom panels provide a secure bottom platform for the holder's contents, and which brace the side panels in upright position, each of which bottom panels hinge from a score on the bottom of each of the two rectangular side panels; a die cut termination of the two rectangular bottom panels by die cutting them short of the length of the rectangular side panels by a distance approximately equal to the width of the bottom panels which is approximately the inside width of the holder, enabling the holder to fold at the score joining the two side panels, without binding or bunching, providing a smooth narrow contour to the end of the literature holder; a male tab lock extending from one bottom panel which inserts in a female lock cut in the score joining the opposite bottom panel to the side panel, locking the panels in place; wherein the improvement comprises cuts made from the four corners where the shelf strip panels meet the side panels and which cuts extend from where the side panels and shelf strip panels meet to a point where the cuts permit the shelf strip panels to flex, whereby the shelf strip panels of the literature holder may be flexed for insertion in a horizontal opening in a surface, which opening is provided for attachment of objects to the surface, so that when the shelf strip panels are inserted in the opening they will hold the literature holder leveraged against the surface with the narrow profile of the holder at a 90 degree angle to the surface, which is economical of display space, and which presents literature which may be held in the literature holder for viewing by people approaching from either direction.

6. A holder for literature made of thin stiff material, comprising two die cut shelf strip panels, each of which have an angle cut in the top surface, and a circular cut describing the shape of the round edge of a retail store's pricing channel which is located at the outer edge of a shelf facing the store aisle in the bottom surface; two rectangular side panels for holding the contents of the holder upright, attached to and adjoining the two shelf strip panel, and which side panels are hinged together by a score; two rectangular bottom panels, attached to the side panels, which bottom panels provide a secure bottom platform for the holder's contents, and which brace the side panels in upright position, each of which bottom panels hinge from a score on the bottom of each of the two rectangular side panels; a die cut termination of the two rectangular bottom panels by die cutting them short of the length of the rectangular side panels by a distance approximately equal to the width of the bottom panels which is approximately the inside width of the holder, enabling the holder to fold at the score joining the two side panels, without binding or bunching, providing a smooth narrow contour to the end of the literature holder; a male tab lock extending, from one bottom panel which inserts in a female lock cut in the score joining the opposite bottom panel to the side panel, locking the panels in place; wherein the improvement is comprised of the addition of four holes, two of said holes cut in each of the two shelf strip panels, and each being located inward from the exterior of the four locations where the shelf strip panel and the side panel meet, at a point where if cuts are made to each of the four holes from the exterior of the shelf strip panels where they join the side panels, the shelf strip panels of the literature holder can be flexed for insertion in a horizontal opening in a vertical surface, which opening is provided for attachment of objects to the surface, so that when the shelf strip panels are inserted in the opening they will hold the literature holder leveraged against the surface with the narrow profile of the holder at a 90 degree angle to the surface, which is economical of display space, and which presents literature which may be held in the literature holder for viewing by people approaching from either direction, and whereby the addition of the said holes permit use of the literature holder on a shelf pricing channel until such time as cuts may be made to the holes.

7. The holder for literature described in claim 6 wherein the improvement consists of four cuts made from where the shelf strip panels meet the side panels and which cuts extend from where the side panels and shelf strip panels meet to a point where the four cuts join the holes which will permit the shelf strip panels to be flexed for insertion in a horizontal opening in a vertical surface, which opening is provided for attachment of objects to the surface, so that when the shelf strip panels are inserted in the opening they will hold the literature holder leveraged against the surface with the narrow profile of the holder at a 90 degree angle to the surface, which is economical of display space, and which presents literature which may be held in the literature holder at an approximately level attitude for viewing by people approaching from either direction.

8. The literature holder described in claim 6 wherein the improvement consists of the addition of four holes, two of said holes to both of the shelf strip panels, the horizontal centers of which two said holes in each of the two shelf strips are separated and which horizontal distance between their centers relates to the horizontal distance between the center of holes which are on peg board which is used for display surface, and which holes are consistently spaced, whereby the shaft of a friction fit fastener, which shaft is attached to a broad flat head, can pass one fastener through each of the four said holes in the shelf strip panels when the holder is assembled from the blank, into the peg board surface, leveraging the literature holder assembled from the blank securely against the surface with the narrow profile of the holder at 90 degrees to the surface, which is economical of display space and presents literature which may be held in it for viewing by people approaching from either direction.

9. A literature holder molded in a single piece of thin stiff material, and comprised of two shelf strip panels, each of which have an angle depression in the top surface, and a circular shape describing the curve of the round edge of a retail store's pricing channel which is located at the outer edge of a shelf facing the store aisle in the bottom surface; two rectangular side panels for holding the contents of the holder upright, adjoining the two shelf strip panels, and which side panels are joined to each other along their vertical length and joined to a common bottom panel along their horizontal length, where in the improvement consists of the single bottom panel being attached to the two side panels whereby the single bottom panel separates and braces the side panels in an upright position to support literature without the necessity of folding or locking bottom flaps in place, and permits the holder to be secured to a store shelf pricing channel, leveraged against the shelf at a 90 degree angle to the shelf which is economical of display space and presents the literature for viewing by people approaching from either direction.

10. The literature holder described in claim 9 wherein a further improvement comprises cuts made from the four corners where the shelf strip panels meet the side panels and which cuts extend from where the side panels and shelf strip panels meet to a point whereby they permit the shelf strip panels to be flexed for insertion in a horizontal opening in a surface, which opening is provided for attachment of objects to the surface, so that when the shelf strip panels are inserted in the opening they will hold the literature holder leveraged against the surface with the narrow profile of the holder at a 90 degree angle to the surface, which is economical of display space, and which presents literature which may be held in the literature holder at an approximately level attitude for viewing by people approaching from either direction.

11. The literature holder of claim 9 wherein a further improvement consists of the addition of four holes, two of said holes cut in each of the two shelf strip panels, and each being located inward from the exterior where the shelf strip panel and the side panel meet, at a point where cuts can be made to each of the four holes from the exterior of the shelf strip panels where they join the side panels, to a point where when the cuts are made, the shelf strip panels can be flexed for insertion in a horizontal opening in a vertical surface, which opening is provided for attachment of objects to the surface, so that when the shelf strip panels are inserted in the opening they will hold the literature holder leveraged against the surface with the narrow profile of the holder at a 90 degree angle to the surface, which is economical of display space, and which presents literature which may be held in the literature holder for viewing by people approaching from either direction.

12. The literature holder of claim 11 with a further improvement wherein the improvement consists of four cuts made from where the shelf strip panels meet the side panels and which cuts extend from where the side panels and shelf strip panels meet to a point where the four cuts join the said holes which will permit the shelf strip panels to be flexed for insertion in a horizontal opening in a vertical surface which opening is provided for attachment of objects to the surface, so that when shelf strip panels are inserted in the opening they will hold the literature holder leveraged against the surface with the narrow profile of the holder at a 90 degree angle to the surface, which is economical of display space, and which presents literature which may be held in the literature holder for viewing by people approaching from either direction.

13. The literature holder of claim 9, a further improvement consists of the addition of four holes, two of said holes to both of the shelf strip panels, the horizontal centers of which two said holes in each of the two shelf strips are separated and which horizontal distance between their centers relates to the horizontal distance between the center of holes which are on peg board, which peg board is commonly used for a display surface, and which holes are consistently spaced, whereby the shaft of a friction fit fastener, which shaft is attached to a broad flat head, can pass one fastener through each of the four said holes in the shelf strip panels, into the peg board surface, leveraging a literature holder securely against the surface to which it has been attached with the narrow profile of the holder at 90 degrees to the surface, which is economical of display space and presents literature which may be held in it for viewing by those approaching from either direction.

* * * * *